United States Patent [19]

Stuart

[11] 4,400,855

[45] Aug. 30, 1983

[54] STRAPPING BUCKLE CONSTRUCTION

[76] Inventor: Bruce W. Stuart, 1911 Heliotrope Dr., Santa Ana, Calif. 92710

[21] Appl. No.: 273,966

[22] Filed: Jun. 15, 1981

[51] Int. Cl.[3] ..... B65D 63/00; F16L 33/10

[52] U.S. Cl. ..... 24/200

[58] Field of Search ..... 24/193, 198, 199, 200

[56] References Cited

U.S. PATENT DOCUMENTS 4,038,726 8/1977 Takabayashi ..... 24/198

4,117,573 10/1978 Nakamura ..... 24/200

*Primary Examiner*—Robert Peshock

*Attorney, Agent, or Firm*—Mahoney & Schick

[57] ABSTRACT

A unitary clamp or buckle for use in conjunction with fabric or other types of strapping is fabricated from polyethylene plastic and includes a body having a pair of locking arms formed integrally therewith, the body having a centrally located strap-receiving opening and bifurcations at the forward extremities thereof encompassing a pair of detent abutments engageable by retention openings in the forward extremity of the locking arms. The bifurcations restrain the forward extremities of the locking arms from displacement from the detent abutments and also from lateral displacement in respect to each other.

10 Claims, 8 Drawing Figures

STRAPPING BUCKLE CONSTRUCTION

BACKGROUND OF THE INVENTION

The present invention relates to a strapping clamp or buckle adapted to be utilized in conjunction with fabric or other types of strapping material to maintain the opposite extremities of a strap fabricated from said material in operative relationship with each other to secure the intermediate portion of the strap in encompassing relationship with an article.

While there have been numerous types of strapping clamps or buckles available in the art, the present invention is restricted to those unitary structures fabricated in one piece from synthetic plastic, such as polyethylene, and capable of maintaining the opposite extremities of respective straps securely in a predetermined locked position.

Exemplary of the state of the art are U.S. Pat. Nos. 3,713,622, 3,823,443, 3,824,654, 3,874,042 and 4,038,726. Prior art buckles and clamps of the character disclosed in the patents mentioned hereinabove are not suitable for use in conjunction with strapping utilized in maintaining one or more packages in operative relationship with each other or in operative relationship with a pallet on which they are stacked. This is due to the fact that some of the clamps or buckles require the formation of holes in the strap and one of them facilitates the easy installation of the buckle on one extremity of the strap prior to inserting the other extremity of the strap in operative engagement with the buckle or clamp.

OBJECTS AND ADVANTAGES OF THE INVENTION

It is, therefore, a primary object of my invention to provide a unitary clamp fabricated from synthetic plastic, such as polyethylene or its equivalents, which is characterized by the fact that it may be easily and readily installed in conjunction with the opposite extremities of a strap to maintain the intermediate portion of the strap in encompassing relationship with an associated package or packages.

The clamp is preferably formed by the injection molding process by the use of the multi-cavity mold, but it will be obvious to those skilled in the art that a variety of techniques may be utilized in the fabrication of clamps in accordance with my invention.

Another object of my invention is the provision of a clamp of the aforementioned character which is capable of sustaining tensional loads imposed upon the strap in a more effective manner than has been achievable with prior art devices. The outstanding performance of the clamp of my invention in this regard is attributable to the combination of structural elements encompassed in the body and the locking arms of the clamp and the cooperative relationship therebetween.

An additional object of my invention is the provision of a clamp of the aforementioned character which includes a body having a centrally located strap-receiving opening and having a bifurcated forward extremity, the bifurcations being constituted by a central projection and the opposite sides of the forward extremity of the body. These bifurcations provide recesses in which are located detent abutments. Operatively connected to the rear extremity of the body by means of integral hinges are elongated locking arms which have their forward extremities provided with retention recesses which are engaged by the detent abutments as the locking arms are forced downwardly into engagement with the body and overlying relationship with the corresponding centrally located opening in the body.

A further object of my invention is the provision of a clamp of the aforementioned character which cannot be readily dislodged from operative engagement with the opposite extremities of the strap with which it is associated, thus preventing inadvertent and accidental dislodgement and imparting considerable security by resisting deliberate dislodgement from operative engagement with the strap.

Other objects and advantages of the invention will be apparent from the following specification and the accompanying drawings which are for the purpose of illustration only.

DESCRIPTION OF PREFERRED EMBODIMENTS OF THE INVENTION

Figure 1:
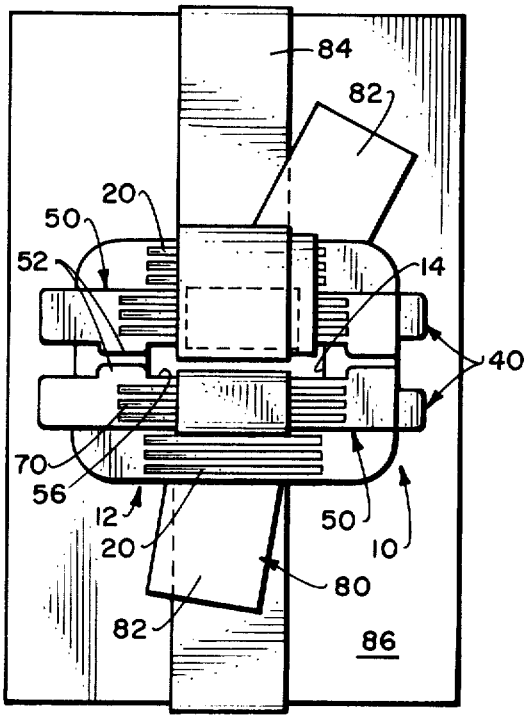
FIG. 1 is a top plan view showing one mode of utilization of the clamp or buckle of the invention.
Figure 2:
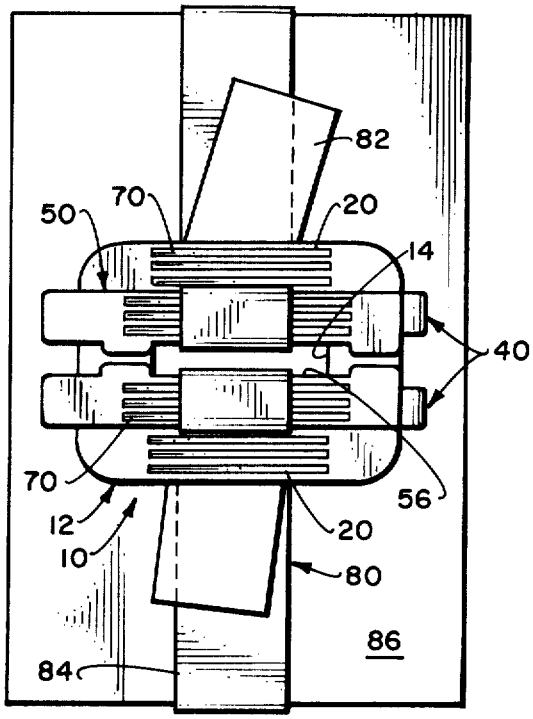
FIG. 2 is a top plan view showing another mode of utilization of the clamp.
Figure 3:
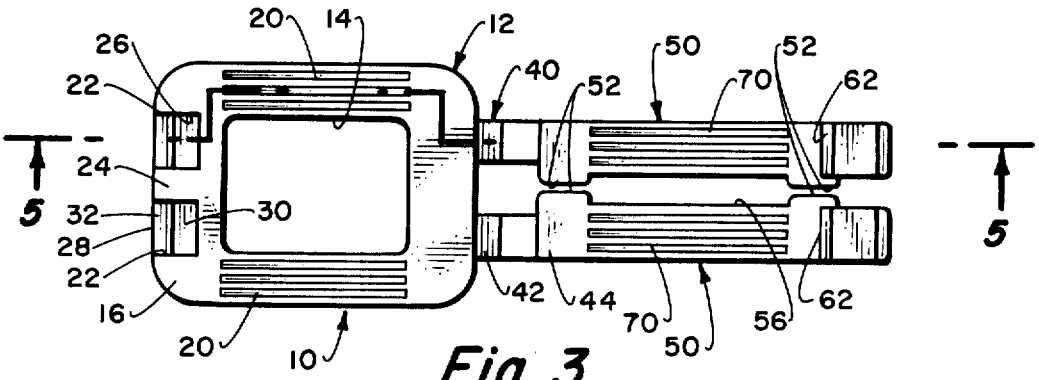
FIG. 3 is a top plan view showing the clamp prior to installation.
Figure 4:
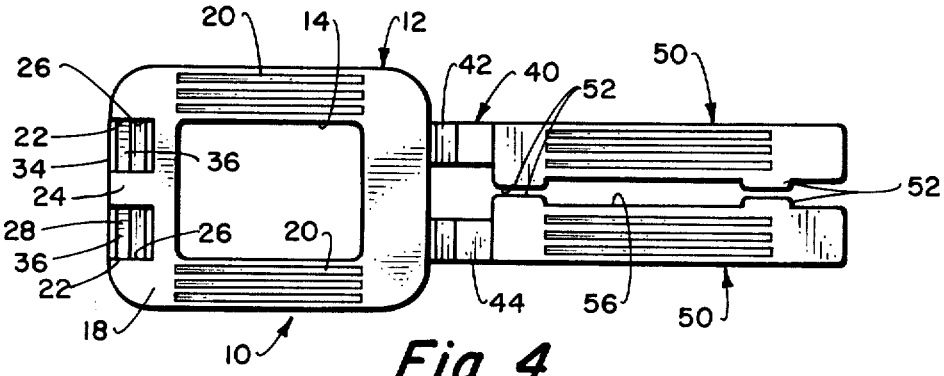
FIG. 4 is a bottom plan view showing the clamp prior to utilization.

Referring to the drawings and particularly to FIGS. 1–4 thereof, I show a locking clamp or buckle 10 fabricated from polyethylene or similar synthetic plastic by utilization of the injection molding process. The entire buckle 10 is formed in a single mold cavity in one piece and includes a body portion 12 which is of generally rectangular configuration and which encompasses a centrally located strap-receiving opening 14, as best shown in FIGS. 3 and 4 of the drawings. The body 12 has planar upper and lower surfaces 16 and 18, respectively, which are provided with frictional ridges 20 adjacent the centrally located strap-receiving opening 14 to aid, in a manner to be described in greater detail below, in resisting withdrawal of the opposite extremities of the strap engaged in the clamp 10 from operative relationship therewith.

Bifurcations 22 are formed at the forward extremity of the body and are defined by a centrally located integral projection 24 and sidewalls 26.

Figure 5:
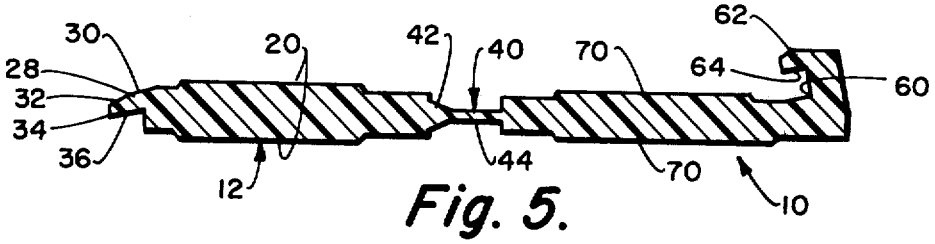
FIG. 5 is a longitudinal sectional view of the clamp taken on the broken line 5—5 of FIG. 3.
Figure 6:
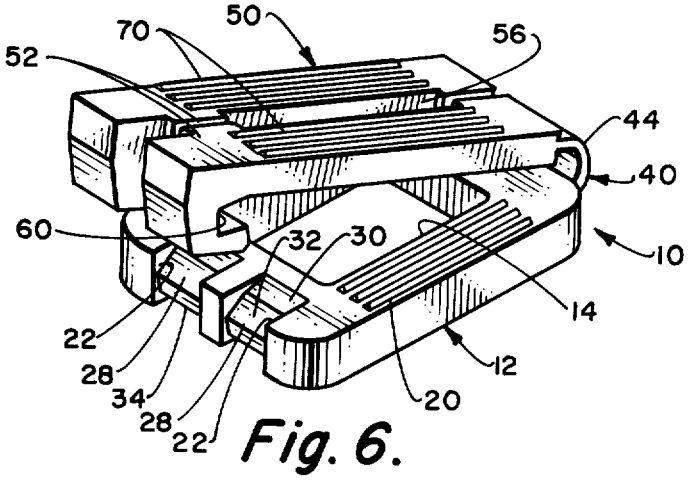
FIG. 6 is an isometric view showing the locking arms of the clamp disposed in overlying relationship with the body of the clamp and prior to the engagement of the forward extremities of the locking arms with the cooperative bifurcations and detent abutments of the forward extremity of the body.
Figure 7:
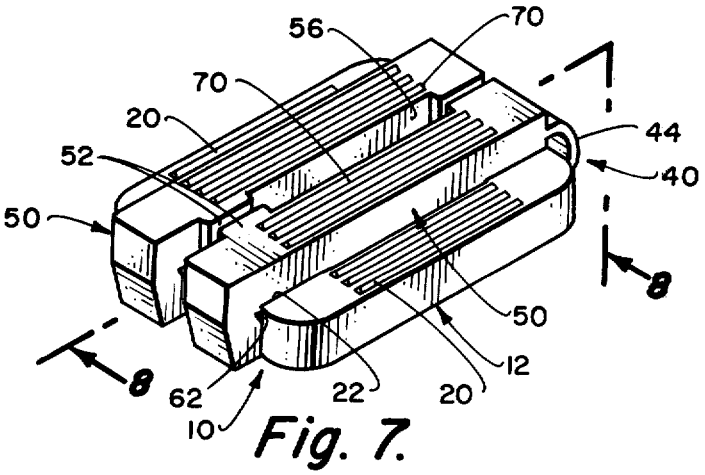
FIG. 7 shows the forward extremities of the locking arms engaged in locking relationship with the corresponding portions of the forward extremity of the body with the extremities of the strap eliminated to facilitate consideration of the operative relationship between the component parts of the clamp.
Figure 8:
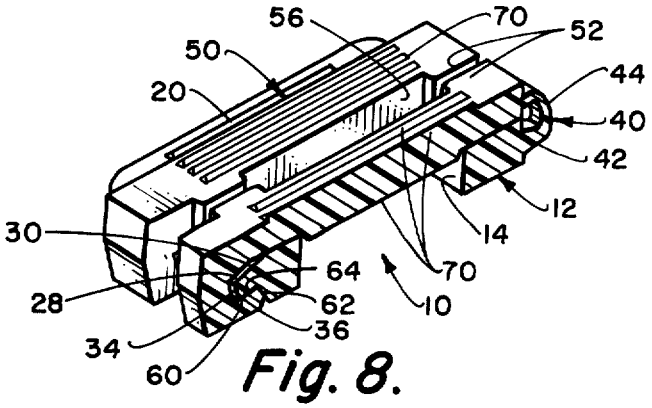
FIG. 8 is a longitudinal sectional view taken on the broken line 8—8 of FIG. 7 showing the operative relationship of the component portions of the body and locking arms.

Located in the bifurcations 22 are detent abutments 28 which, as best shown in FIGS. 6 and 8 of the drawings, include downwardly inclined planes 30 and 32 for a purpose which will be described in greater detail below. The forward extremity 34 of each of the detent abutments 28 is downwardly and rearwardly inclined, as best shown in FIGS. 3, 5 and 6 of the drawings. The planar underside 36 of each of the abutments 28 is upwardly and rearwardly inclined. The function of the inclined planes will be described in greater detail hereinbelow.

It will thus be seen that bifurcations 22, as constituted by the centrally located projections 24 and the sidewalls 26, provide retaining recesses in which the detent abutments 28 are located for a purpose which will be described in greater detail below.

Formed integrally with the rearward extremity of the body 12 is a pair of hinges 40, each hinge having a triangular base 42 and a strap portion 44 of reduced cross section, the triangular base 42 providing greater strength at the interface between the body 12 and the respective hinge 40 and the strap portion 44 providing for reduced resistance to bending.

Formed integrally with the strap portions 44 of the hinges 40 are identical locking arms 50 which have abutment bosses 52 provided thereupon and normally disposed in spaced relationship with each other, but which can coact by engaging each other to prevent undue lateral movement of the locking arms 50 during the installation procedure or when subjected to undue loads.

The abutment bosses 52 also serve as means for defining an elongated strap-receiving opening 56, as best illustrated in FIGS. 1 and 2 of the drawings, and the bosses 52 serve to prevent extreme misalignment of the opposite extremities of the strap during the interengagement of said opposite extremities in operative relationship with the relevant locking arms 50.

Provided in the free extremities of the locking arms 50 are retention recesses 60 which, as best shown in FIG. 5 of the drawings, incorporate inclined planes 64 facilitating the engagement of said recesses with the detent abutments 28, in a manner to be described in greater detail below. Inclined planes 62 are provided on the external surfaces of the free extremities of the locking arms 50 to facilitate the locking engagement of the detent abutments 28 in the retention recesses 60, in a manner to be described in greater detail below.

The upper and lower surfaces of the locking arms 50 are provided with friction ridges 70 to provide frictional areas on said locking arms adjacent the strap-receiving opening 14 in body 12 and the strap-receiving opening 56 defined by the bosses 52.

The utilization of the clamp 10 in conjunction with a strap 80, as best shown in FIGS. 1 and 2 of the drawings, encompasses the wrapping of the intermediate portion 84 of the strap 80 around a package or number of packages 86 and then threading one end 82 through the centrally located opening 14 and elongated opening 56 and downwardly around the upper locking arm 50, as seen in the drawings, and finally drawing the free end 82 under the body 12. In FIG. 1 this process is completed by a double wrap of the one extremity 82 around the upper locking arm 50 and the relevant portion of the body 12. The method of installation shown in FIG. 1 assures that there will be no possible slippage of the free end 82 of the strap during the installation of the opposite free extremity of the strap 80 in conjunction with the clamp 10.

Of course, the wrapping of the strap around the arm 50 is accomplished while the arm is open, which greatly facilitates the installation of the free extremity 82 of strap 80 upon the buckle. The arm 50 is then brought downwardly against the body 12 into the position shown in FIGS. 1 and 2 and 6 and 7 of the drawings with the forward extremity of the arm 50 being forced downwardly against the ramp-like configuration of the detent abutment 28. As the forward extremity of the locking arm 50 is forced downwardly into the respective bifurcation 22 the inclined plane 62 thereupon engages the inclined planes 30 and 32 of the detent abutment, facilitating the downward movement until the inclined surface 62 engages the corresponding inclined surface 34 on the forward extremity of the detent abutment 28 and the detent abutment snaps into the retention opening 60.

After the securement of one side of the clamp 10 to the respective extremity 82 of the strap 80, the free end of the strap 82, shown as the lower extremity in FIGS. 1 and 2, can then be wrapped around the free arm, which is shown in the lower position in FIGS. 1 and 2, and drawn under the body 12. The free arm 50 is then lockingly engaged with the body 12 in the same manner as the previously described locking action between the other arm 50 and the body 12. After both extremities 82 of the strap 80 have been so engaged, the last installed extremity 82 can be pulled with pliers or other instruments to further tighten the intermediate portion 84 of the strap 80 in encompassing relationship with the package or packages 86.

When the extremities 82 of the strap 80 are so installed, the frictional areas constituted by the ridges 20 and 70 on the body 12 and locking arms 50 materially assist in maintaining the opposite extremities 82 of the strap 80 in operative relationship with the buckle 10.

Moreover, as the opposite extremities 82 of the strap 80 are subjected to tensional loads, the tendency of the arms 50 to be pulled out of engagement with the forward extremity of the body 12 is resisted because of the positive engagement of the forward extremities of the arms 50 arising out of the interengagement of the detent abutments and retention openings 28 and 60, respectively. Moreover, the fact that the forward extremities of the locking arms 50 are located within the recesses constituted by the bifurcations materially assists in preventing tensional loads from dislodging the forward extremities of the locking arms 50 from operative engagement with the corresponding forward extremity of the body 12.

Therefore, I provide by the clamp of my invention a lightweight, positive locking device which can be manufactured and sold at reasonable cost; which can be installed with tremendous ease and facility and which resists torsional loads more effectively than prior art devices.

In addition, no modification of the strap is entailed to accommodate it to utilization in the clamp of my invention and the various components of the unitary clamp function effectively to maintain the opposite extremities of the locking strap in operative engagement with the clamp.

I claim:

1. A unitary clamp for maintaining the opposite extremities of a strap in predetermined, locked relationship with each other and the intermediate portion of said strap in encompassing relationship with an article, including a body, said body having a centrally located strap-receiving opening therein and incorporating spaced detent abutments at its forward extremity, said body having an integral pair of hinges at its rear extremity and each of said hinges having a locking arm formed integrally therewith, said locking arms having confronting abutment means thereupon and located in spaced relationship with one another, the forward extremities of said locking arms having retention recesses thereupon for receiving said detent abutments on said body and said detent abutments being retained in operative relationship with said retention recesses to prevent disengagement of the opposite extremities of said strap from locked operative relationship with said clamp and the intermediate extremity of said strap from disengagement with said article.

2. A clamp of the character defined in claim 1 in which said abutment means on said arms define an elongated opening overlying said centrally located opening in said body.

3. A clamp of the character defined in claim 1 in which said integral hinges include relatively rigid base portions on said body and flexible strap portions intermediate said locking arms and said base portions to facilitate movement of said locking arms on said body.

4. A clamp of the character defined in claim 1 in which said body has planar surfaces thereupon incorporating frictional retention means adjacent said centrally located strap-receiving opening and engageable with the opposite extremities of said strap to retain said opposite extremities in operative engagement with said clamp.

5. A clamp of the character defined in claim 4 in which said locking arms have planar surfaces overlying said centrally located opening in said body and incorporating frictional retention means cooperative with the opposite extremities of said strap to prevent dislodgement of said opposite extremities from operative engagement with said locking arms.

6. A unitary clamp for maintaining the opposite extremities of a strap in locked predetermined relationship with each other and the intermediate portion of said strap in encompassing relationship with an article including, a body having a centrally located strap-receiving opening therein, said body having a forward extremity incorporating spaced detent abutments thereupon, said forward extremity providing a central projection between said abutments and outer walls defining the outer edges of said abutments, said body having spaced, integral hinges on its rearward extremity and a pair of elongated locking arms mounted on said hinges for movement from a substantially co-planar position with said body into overlying relationship with said body, said locking arms having retention recesses at their forward extremities, said retention recesses being engageable by said detent abutments as the forward extremities of said arms are pushed downwardly over said detent abutments to retain the intermediate portions of said arms in overlying relationship with said centrally located opening in said body and to maintain said opposite extremities of said strap in locked relationship with said arms and said body.

7. A clamp of the character defined in claim 6 in which said arms have spaced pairs of bosses thereupon for preventing undue lateral deflection of said arms when disposed in parallelism with each other and in overlying relationship with said central strap-receiving opening in said body.

8. A clamp of the character defined in claim 6 in which said projection and said walls define bifurcations and said detent abutments are located within said bifurcations so that, when said retention recesses receive said abutments, the forward extremities of said locking arms are restrained by said projection and sidewalls from lateral or upward movement with respect to each other.

9. A clamp of the character defined in claim 8 in which said body incorporates frictional areas adjacent said opening for facilitating the retention of said opposite extremities of said strap by said supporting arms.

10. A device of the character defined in claim 9 in which the portions of said supporting arms overlying said opening incorporate frictional areas cooperative with said strap and corresponding frictional areas on said body to maintain said extremities of said strap in operative relationship with said clamp.

* * * * *